US005465753A

United States Patent [19]

Schwartz

[11] Patent Number: 5,465,753

[45] Date of Patent: Nov. 14, 1995

[54] SAFETY VESSEL AND VALVE ASSEMBLY

[76] Inventor: John E. Schwartz, 1642 Buckhorn La., Billings, Mont. 59105

[21] Appl. No.: 263,568

[22] Filed: Jun. 21, 1994

[51] Int. Cl.[6] ..... A01M 7/00

[52] U.S. Cl. ..... 137/587; 137/348; 137/349; 137/350; 105/358; 105/360

[58] Field of Search ..... 105/358, 359, 105/360; 13/348, 349, 350, 587; 251/144

[56] References Cited

U.S. PATENT DOCUMENTS

| | | | |
|---|---|---|---|
| Re. 19,537 | 4/1935 | Pierce | 105/360 |
| 845,752 | 3/1907 | Brown | 105/360 |
| 848,286 | 3/1907 | Brown | 105/360 |
| 2,102,124 | 12/1937 | Lithgow | 105/358 |
| 4,044,690 | 8/1977 | Deeks | 105/358 |
| 4,872,640 | 10/1989 | Schwartz | 251/147 |
| 5,020,447 | 6/1991 | Loevinger | 105/360 |
| 5,113,893 | 5/1992 | Schwartz | 137/347 |
| 5,141,013 | 8/1992 | Zink et al. | 137/350 |
| 5,222,517 | 6/1993 | Zink et al. | 137/348 |

FOREIGN PATENT DOCUMENTS

| | | | |
|---|---|---|---|
| 1108252 | 6/1961 | Germany | 105/358 |

*Primary Examiner*—A. Michael Chambers
*Attorney, Agent, or Firm*—Wallenstein & Wagner, Ltd.

[57] ABSTRACT

A safety vessel and valve assembly for storage and transport of chemicals is disclosed. The assembly includes a vessel housing a series of retracted valves. A thickened mounting plate provides an area to mount and protect the valves within the vessel, while attaching to the vessel in such a manner to maintain the smooth exterior surface of the vessel. An impact softener and heat resistant shroud covers the vessel exterior protecting the vessel, its valves and chemical cargo during a collision or other external forces.

20 Claims, 9 Drawing Sheets

SAFETY VESSEL AND VALVE ASSEMBLY

TECHNICAL FIELD

The present invention relates to a vessel and valve assembly, and more particularly to a reinforced vessel and internal safety valve assembly for storing and transporting hazardous gases and liquids.

BACKGROUND OF THE INVENTION

In recent years, the standard of living in this country has caused a growing need for chemical compounds of all kinds, including toxic, flammable and otherwise hazardous and valuable pressurized gases and liquids. Transportation and storage of such chemicals has always been an important concern. Furthermore, safe, reliable transportation and storage of hazardous materials has become a highlight in recent years with the growth of environmental protection and awareness. Transportation tanks used on railroads, semi-trailer trucks and modular containers for sea and land generally have inlet-outlet ports which are used to load and unload chemical cargo. These inlet-outlet ports are typically covered and closed by valves and other fixtures which protrude out from the surface of the vessel shell. Such protrusions are vulnerable to damage or rupture due to collisions, fire, vandalism or the like.

Many attempts have been made to protect these valve fixtures. One such example is that of a dome structure as placed over the valves or fixtures. While these dome structures help to streamline the vessel and protect the valve and access door assemblies, they still form abutments which can tear or be crushed during an accident.

Another example is the use of large recessed areas covered by a structural plate to deflect colliding objects. A group of portals and valves are placed at the bottom of the recess. These recesses are often so large that they can weaken the structural shell of the vessel. In addition, the recesses can be difficult to maintain because the recesses allow water to accumulate, possibly leading to corrosion of the vessel shell. Furthermore, the recessed valves make connections to the valve portals inconvenient because the operator must manipulate heavy wrenches while stretching outward and downward to connect and disconnect conduit to the portals for loading and unloading purposes.

Accordingly, there is a need for a reinforced vessel and valve assembly to protect a chemical cargo which can withstand the forces of an accident, fire, corrosion or vandalism and yet provide easy access to the valves and fixtures being protected. In addition, there is a need for an area within the vessel shell having a sufficient thickness to mount threaded valves and fixtures without weakening the vessel shell. The present invention provides such a device.

SUMMARY OF THE INVENTION

The present invention is a safety container for use in chemical storage and transportation. Specifically, a safety vessel and valve assembly is disclosed in which the valve fixtures are located beneath a thickened mounting section of a vessel, rather than projecting outside the shell of the vessel, thereby protecting the valves from possible rupture, damage or leakage.

The assembly of the present invention comprises a tank or vessel functioning as a container for gas or liquid, usually under pressure, having a smooth exterior surface with at least one opening, a series of retracted valves located beneath the openings in the vessel surface and a thickened reinforcement means for mounting the retracted valves while maintaining the smooth exterior surface of the vessel. The openings in the exterior surface of the vessel include an inlet-outlet portal. A sealing plate is placed over the portals, nesting in a rim surrounding the portal so that the top of the sealing plate is flush with the shell of the vessel. Furthermore, the vessel is covered by a multi-layered impact and fire resistant shroud.

Other advantages and aspects of the present invention will become apparent upon reading the following description of the drawings and the detailed description of the invention.

BRIEF DESCRIPTION OF THE DRAWINGS

In order that the present invention may be understood, it will now be described by way of example, with reference to the accompanying drawings in which.

DETAILED DESCRIPTION

Figure 1:
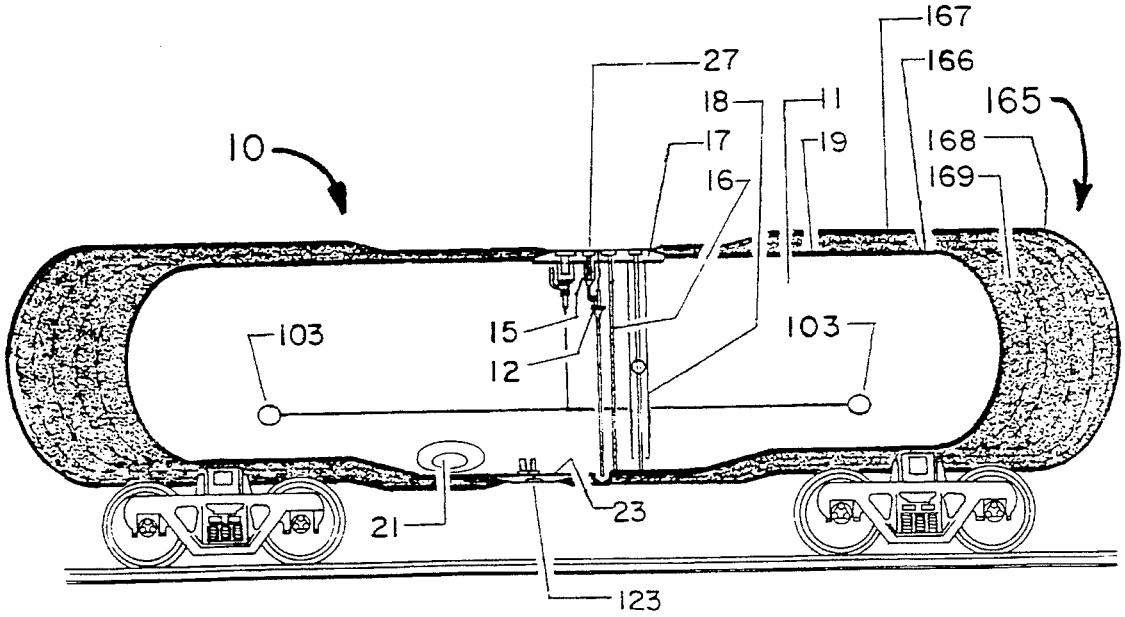
FIG. 1 is perspective view showing a railroad tank car with the thickened mounting plate and a series of retracted valves located within the vessel and impact softeners and heat resistant shrouds on each end of the vessel.
Figure 2:
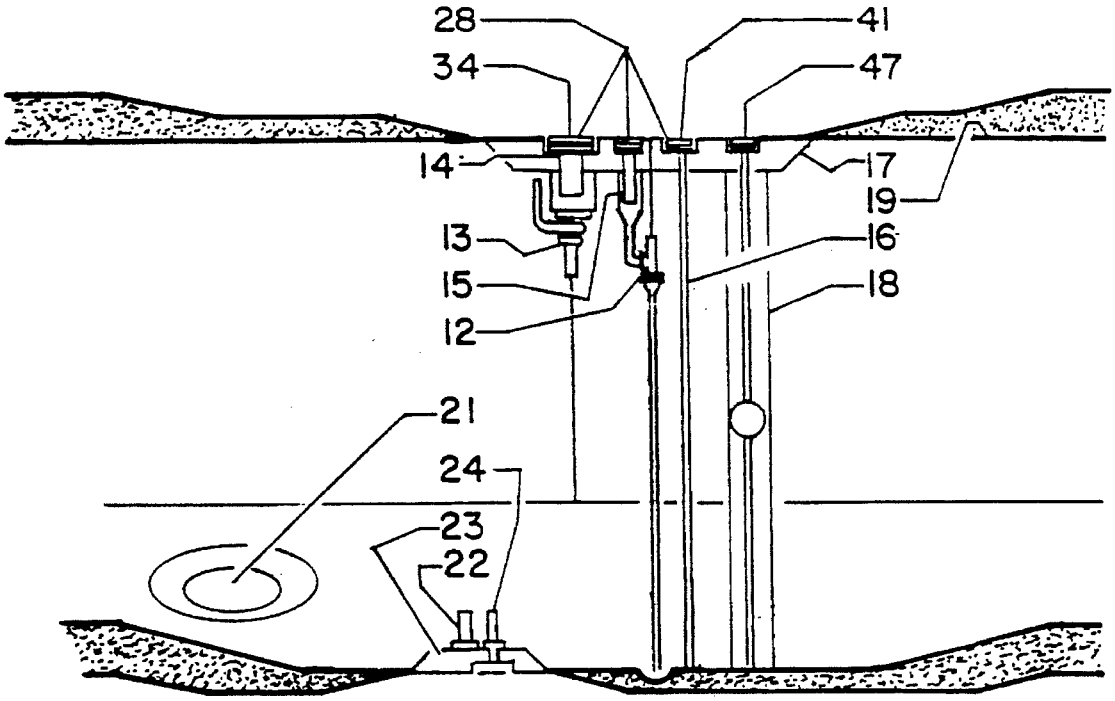
FIG. 2 is an enlarged perspective view of the vessel shown in FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the sole embodiment illustrated. The safety vessel and valve assembly, generally designated by the reference numeral 10, is shown in FIGS. 1 and 2. The safety vessel and valve assembly 10 includes a vessel or tank 11 that functions as a container for gas or liquid, usually under pressure. The assembly also includes a series of retracted valves and internal tank safety shut-off valves 12, 15, 22, 24 located beneath openings in the form of inlet-outlet portals 27, 123 in the vessel 11. The vessel 11 also includes reinforcement means in the form of a thickened mounting plate 17 which provides a thickened shell area for mounting the valves and other apparatus while maintaining the smooth exterior surface of the vessel shell 19.

The vessel 11 may be a stationary tank, a process vessel, a highway transport tanker, a railroad tank car as in the present embodiment, or the like. The exterior surface or shell 19 of the vessel 11 is provided with at least one opening in the form of inlet-outlet portals 27, 123. These portals can be on the top, bottom and side of the vessel 11. The thickness of the mounting plate 17 surrounding the inlet-outlet portals 27, 123, must be of sufficient thickness to accommodate enough tapered thread to establish a reliable seal when mounting a retracted valve or other fixtures, and yet not create a weakness in the vessel shell 19 due to the mounting of the valves. The mounting plate 17 is welded into the vessel shell 19, providing enough depth to accommodate the retracted valves of the present invention, while adding strength to the vessel shell 19.

Figure 7:
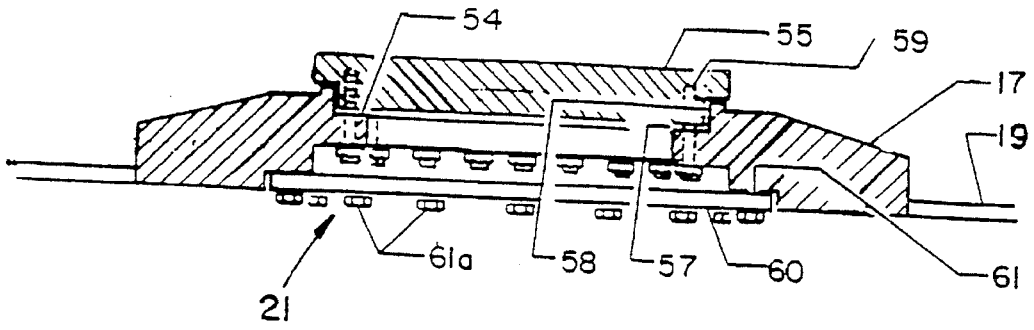
FIG. 7 is a front view of a sealing door covering the entrance to the vessel.
Figure 7A:
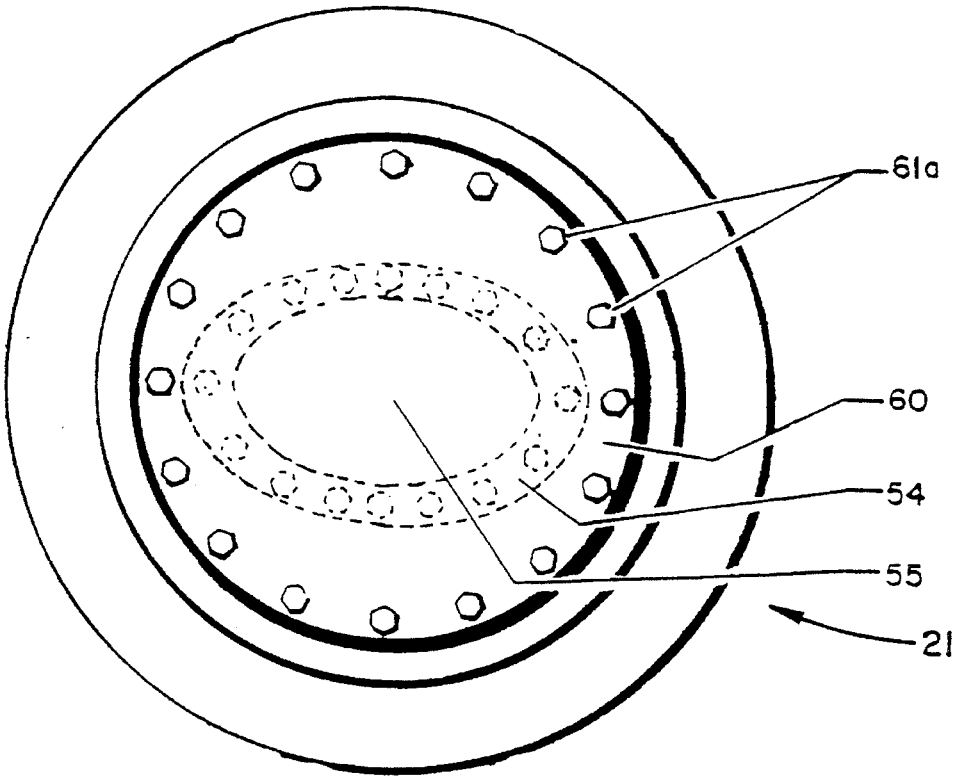
FIG. 7A is a side cross-sectional view of the sealing door in FIG. 7.

One opening is the vessel entry area 21 as shown in FIG. 1, and more specifically in FIGS. 7 and 7A. The vessel entry opening 21 includes an elliptical internal pressure sealing door 55 and an external deflection door 60 that are concentric with one another. The deflection door 60 is nested into a form-fitting recessed area 61 in a thickened mounting plate 17 that is welded monolithically into the vessel shell 19. The recess 61 is sufficiently below the outer surface of the thickened mounting plate 17 so that when the deflection door 60 is in position, its outer surface, the outer surface of the mounting plate 17, and the outer surface of the vessel shell 19 are flush with one another. The thickness of the deflection door 60 is at least equal to the thickness of the vessel shell 19. Bolts 61*a*, or another securing means are installed through the deflection door 60 into threaded holes in the planer surface 61 to secure the deflection door 60. The pressure sealing door 55, recessed further within the vessel 11 than the external deflection door 60, has preferably an elliptical shape. The pressure sealing door 55 is at least large enough for a normal sized individual to pass through with relative ease and to accommodate the passage of fittings required within the vessel 11. The pressure sealing door 55 opens inwardly, employing the pressure of the product in the vessel 11 to add to the force of closure. A ledge 57 is provided around the entire periphery of the door 55 for engagement with a standard gasket (not shown), establishing an elliptical sealing surface 54. An inner curb 58 of the ledge 57 serves as a retainer for the standard gasket, restricting it from sliding out of place and assists in aligning the pressure sealing door 55 when it is closed. The pressure sealing door 55 is fitted with a plurality of threaded bolt holes 59 that when mated with compatible bolts will accomplish the leakproof seal.

As shown in FIG. 2, the vessel shell 19 is thickened in select areas around portals and entry ways through the use of a thickened mounting plate 17. The thickened mounting plate 17 creates a shell thickness having the following advantages: provides a thickness sufficient for accommodating deep threaded holes for bolts without penetrating into the pressurized cargo space resulting in leakage; accommodates threaded areas in the inlet-outlet portals for the retracted valves; accommodates small recesses to nestle sealing cover plates so the outer surface of the sealing plate is flush with the outer surface of the vessel shell; accommodates the attachment of conduit and other fixtures to the inside of the vessel shell; accommodates quick couplers for hydraulic fluids from the outside of the vessel; and, allows boring of conduit holes through to direct the pressurized hydraulic fluid to the inverted valves. The thickened mounting plates 17 also provide structural reinforcement to the vessel shell 19, especially when large openings are cut into the shell for mounting valves and other fixtures.

One area which benefits from the added structural reinforcement of the thickened mounting plate is the entry area 21. The thickened mounting plate 17 around the entry area 21 serves a double purpose—as a frame to attach the elliptical internal door 55 and the external deflection door 60, and a means to replace the structural strength to the shell 19 after removing material to create the large entry way.

Whether the thickened mounting plate 17 around a portal is intended as a mounting means for valves and fixtures, or as a reinforcement means for the vessel shell, an important feature is that the mounting plate is installed in such a manner that its outer surface is flush with the outer surface of the vessel 11, providing a continuation of the same smooth curved contour of the vessel. This continuous surface is accomplished by welding the mounting plate 17 in a leakproof manner below the outside of the shell 19 as seen in FIGS. 1 and 2. The smooth continuous surface provides a deflection surface to any object that may collide with the vessel 11 during an accident or under normal transportation conditions. Deflection of objects reduces the chances of punctures and rips to the vessel shell 19. The thickened mounting plates 17 may be sized for a single fixture and detached from one another on the vessel shell 19 or may be large enough to accommodate several fixtures in one area.

One such mounting plate 17 is located at the top of the vessel 11. FIG. 2 shows one embodiment where the mounting plate 17 is the large, continuous version to accommodate several valve fixtures, including an inlet-outlet retracted valve 15 with a safety shut-off valve 12, a pressure safety relief valve 14 with a safety pressure relief valve shut-off 13, a temperature indicator 16 and a liquid level indicator 18, each to be discussed in more detail later. The mounting plate 17 comprises several small recesses 28, 34, 41, 47 to accommodate each of the above-listed valves, respectively. Generally, each of the recesses 28, 34, 41, 47 include a flat planar bottom manufactured sufficiently smooth to produce a leakproof assembly when a standard gasket is employed between its planar bottom and a cover plate 43. The cover plate 43 is held in position with a series of bolts secured through the cover plate and into the thickened mounting plate. The thickness of the mounting plate 17 assures that the bolts can be sufficiently secured without penetrating the vessel 11 itself, causing unwanted leakage of product. Each of the recesses 28, 34, 41, 47 has a depth sufficient so the cover plate 43 and the bolts holding it in position, are below the outer surface of the mounting plate 17. Each of the recesses 28, 34, 41, 47 and the corresponding cover plate 43 and bolt assemblies will be discussed in detail for each valve fixture as the valves are discussed in detail below.

Figure 3:
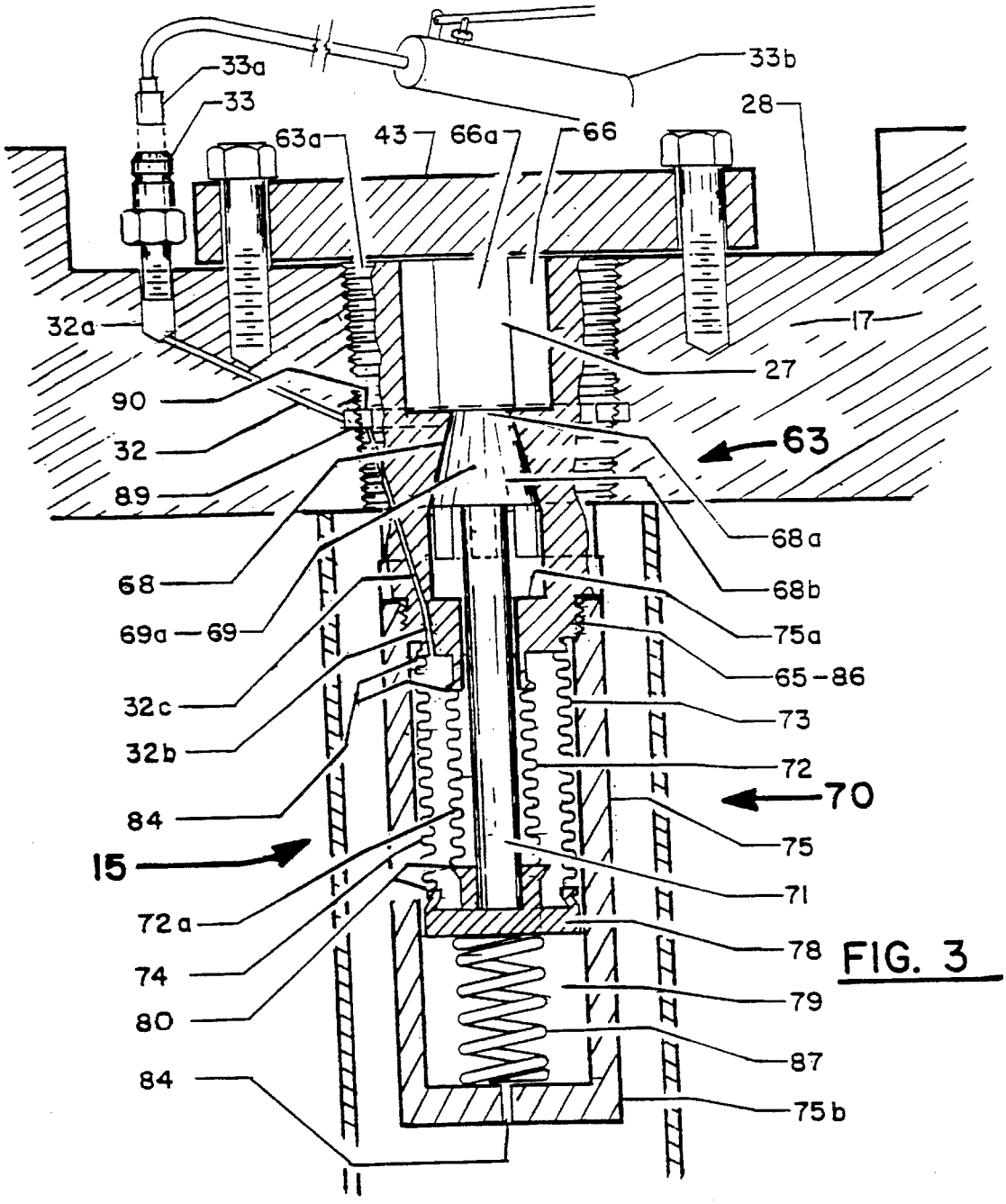
FIG. 3 is a front longitudinal sectional view of a retracted and valve actuator assembly.
Figure 4:
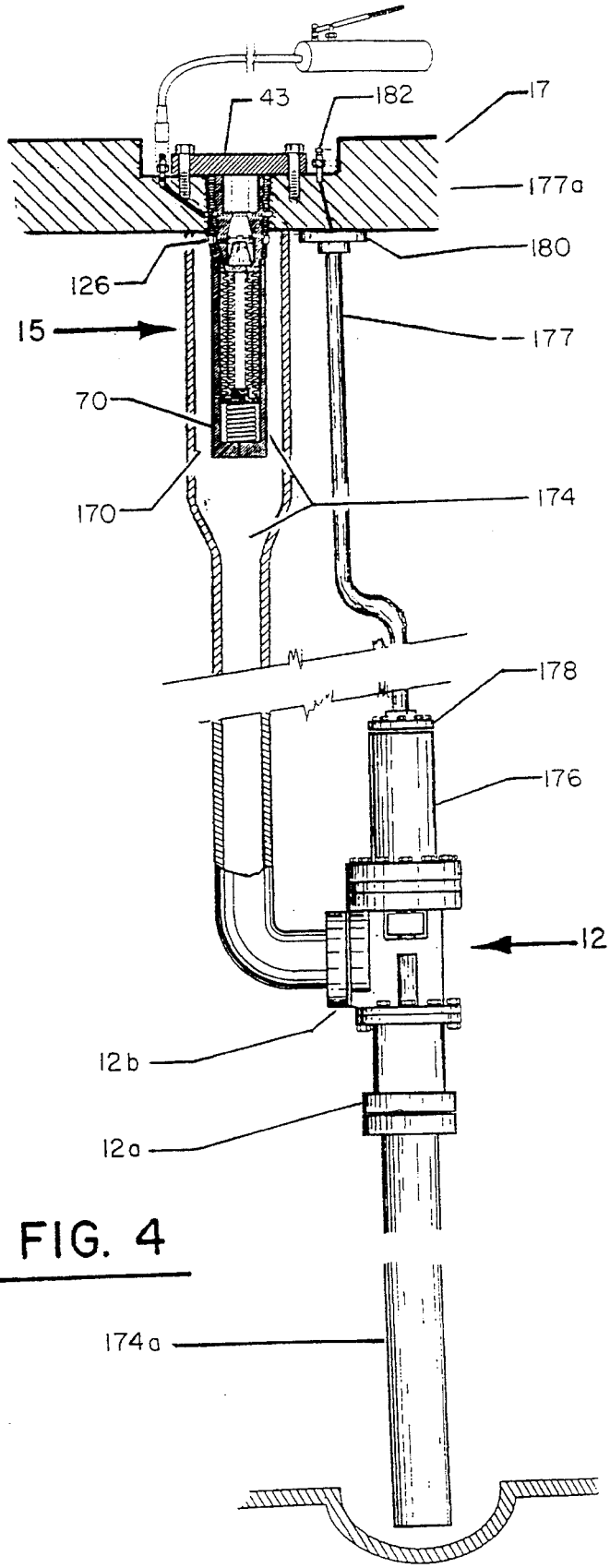
FIG. 4 is a front longitudinal sectional view of the valve in FIG. 3 together with a front view of a safety shut-off valve and a duct to select liquid from the bottom of the vessel or vapor from the top of the vessel.

As shown in FIGS. 3 and 4, a cylindrical inlet-outlet portal 27 lined with a tapered thread 27*a* and fitted with an inlet-outlet retracted valve 15 resides in the second recess 28 of the top mounting plate 17. The large end of the truncated conical shape of the inlet-outlet portal 27 opens to the outside of the vessel 11. The retracted valve 15 comprises a valve body 63 and an actuator assembly 70 that are adjacent to each other and disposed concentrically along the same axis. The valve body 63 is in the shape of a outwardly facing truncated conical shape with tapered threads that are mateable to the conical shape of the portal 27. When the valve body 63 is inserted into the portal 27 and rotated about its axis, the threads tighten up to create a leakproof seal. Located at the small end of the valve body 63 is a straight machine thread for the purpose of attaching the valve body 63 to the actuator assembly 70. These machine threads 65 are also concentric with the valve body 63 axis.

The large end 63a of the truncated conical-shaped valve body 63 faces outward from the inlet-outlet portal 27 and comprises a conduit opening 66 concentric with the axis of the valve body 63. This opening 66 is one end of the product conduit 66*a* through which the product flows into and out of the vessel 11. The conduit opening 66 can be any suitable shape but is preferably hexagonal so an Allen wrench can be used to rotate the valve body 63 into the portal 27, creating a leakproof seal.

Below the conduit opening 66 of the valve body 63 is a valve seat 68 that is a first truncated conical concave surface facing downwardly toward the actuator assembly 70 and concentric with the axis of the valve body 63 and the product conduit 66*a*. The small end 68*a* of the truncated valve seat 68 faces upward toward the outside conduit opening 66. The larger open end 68*b* of the truncated conical valve seat 68 faces a matching second truncated conical convex surface 69a of a valve head 69. The valve head 69 slideably engages with the valve seat 68 forming a leakproof seal or conversely, when the valve head 69 is slid away from the valve seat 68, product can flow freely from the vessel 11 (FIG. 3).

The second main component of the inlet-outlet retracted valve 15 is an actuator assembly 70. The actuator assembly 70 includes a connecting rod 71, a first bellows seal 72, a second bellows seal 73 and a piston head 78, all contained within an actuator housing 75. The elongated connecting rod 71 is securely attached to the large end of the valve head 69 in a manner suitable to allow the valve head 69 to articulate with the connecting rod 71. One such attachment means is a ball and socket assembly (not shown) which allows the valve head 69 to adjust in its position more freely so valve head 69 has better seating within the valve seat 68 providing a better leakproof seal.

On the end opposite the valve head 69, the connecting rod 71 is attached by a machine thread to a disk-shaped piston head 78. The piston head 78 attaches in a rigid manner to the elongated connecting rod 71 so piston head 78, connecting rod 71 and valve head 69 move together in unison inside the actuator housing 75. The piston head 78 has a diameter such that it is a loose fit within the actuator housing 75. It is important that this fit be sufficiently loose so fluid may pass between the piston head 78 and the actuator housing 75, thus reducing trapping of fluid which would in turn resist the motion of the piston head 78 and connecting rod 71.

As shown in FIG. 3, the first and second bellows seals 72, 73 are welded to the piston head 78. The first bellows seal 72 and the second bellows seal 73 are generally cylindrical in shape with open ends and deep corrugations 74 around the circumference in a side by side manner for the length of the bellows seals 72, 73. It is important that the bellows seals 72, 73 be long enough to provide a sufficient number of corrugations 74 that if force is applied to the piston head 78 and the bellows seals 72, 73, pressing them together lengthwise, the corrugations 74 divide the distortion equally so no corrugation 74 exceeds its modular elasticity, and each works efficiently. The first bellows seal 72 is generally smaller than the second bellows seal 73 so the first will fit into the second. One end 80 of the bellows seals is welded to the piston head 78 while the opposite end 84 is welded to the valve body 63 in a dependable manner to withstand many flexing motions without fatiguing and cracking the weld.

The actuator housing 75 can be of any suitable shape but is preferably a cylindrical shape so as to allow smooth motion of the piston head 78, the elongated connecting rod 71 and the valve head 69. The actuator housing 75 has an open end 75a and a closed end 75*b*. The closed end 75*b* of the actuator housing 75 is provided with a portal 84 which allows the contents of the vessel 11 to enter the interior section 79 of the actuator housing 75 above the piston head 78. A filter (not shown) can be attached to the portal 84 if the product in the vessel 11 will cause a sediment which could eventually accumulate and restrict the motion of the actuator assembly 70. The open end 75*a* of the actuator housing 75 comprises a machine thread 86 on the inner surface joining with the machine thread 65 on the outside surface of the valve body 63, thus providing an attachment means for the two parts. The actuator housing 75 functions as a protective shield covering the actuating assembly 70.

Normally the pressure of the contents of the vessel 11 against the top of the piston head 78 is sufficient to slide the actuator assembly 70 and the valve head 69 in the closed position and maintain it closed. In the event the contents is not pressurized, a spring 87 may be added between the inside of the closed end 75*b* of the actuator housing 75 and piston head 78. The spring 87 would supply enough force to slide the valve head 69 into the valve seat 68, closing the valve 15. While the retracted valve 15 essentially closes without the need for human intervention, it is necessary to open the retracted valve 15 manually. The opening means includes a first quick coupling connector 33 and a first hydraulic conduit 32. The first hydraulic conduit 32 includes an opening 32*a* in the flat planar bottom of the recess 28 which opens to the outside of the top mounting plate 17 continuing into a first channel 89 that circumscribes the inner face of the tapered threaded portion 27*a* of the inlet-outlet portal 27. The opening 32*a* of the first hydraulic conduit 32 is fitted with a first quick connector 33 that is compatible with a standard quick coupling connector 33 associated with a high pressure hydraulic fluid source that may be in the form of a hand operated pump 33*b* (FIG. 3). Communicating with the first channel 89 is a second channel 90 which circumscribes the valve body 63. Connecting through the second channel 90, the first hydraulic conduit 32 continues through the valve body 63 emerging between the bellows seals 72, 73 at a point 32b where the seals join with the valve body 63. The first hydraulic conduit 32 directs pressurized fluid into the sealed area 72*a* between the bellows 72, 73 and ultimately against the inside of the piston head 78. When the force of the manually applied pressure exceeds the force of the product pressure or the pressure exerted by a spring 87 if used, the piston head 78, connecting rod 71 and valve head 69 will move downward together opening the retracted valve 15 and releasing the product within the vessel 11. If the pressurized fluid is released, the reverse occurs and the retracted valve 15 closes.

As shown in FIG. 4, the entire retracted valve 15 is encased in a housing generally in the form of a cylindrical tube 170. The cylindrical tube 170 is secured in a leakproof manner, preferably by welding, to the thickened mounting plate 17. The cylindrical tube 170 has a diameter sufficient to accommodate the actuator assembly 70 of the retracted valve 15 and provide enough space to create a duct 174 to conduct product from the vessel 11 to the inlet ports 126 of the retracted valve 15.

In FIG. 4, the duct 174 also serves to connect the retracted valve 15 to an internal safety shut-off valve 12. The safety shut-off valve 12 is described in U.S. Pat. No. 4,872,640, incorporated by reference herein. The safety shut-off valve 12 functions as a backup to the retracted valve 15. As described in the '640 patent, the actuator 176 of the internal safety shut-off valve 12 has a first flange 178 comprising the top of the actuator 176, connected by an actuating fluid conduit 177 to a second flange 180 which is welded to the inside surface of the mounting plate 17. The actuating fluid conduit 177 continues through a channel 177*a* in the mounting plate 17, connecting to a hydraulic conduit quick connector 182 similar to the hydraulic conduit quick connector 33 previously described.

The safety shut-off valve includes two product connection flanges 12*a* and 12*b*. Product connection flange 12b is attached to the duct 174 in a secure leakproof manner, while product connection flange 12*a* is connected to an extension 174*a* of duct 174, as shown in FIG. 4. The shut-off valve 12 is positioned within the duct 174 and 174*a* and in position to close off the product from flowing through the ducts. The extension duct 174*a* can be extended to any place in the vessel 11, including the lowest level to the highest level, to gather liquids or gases.

Figure 5:
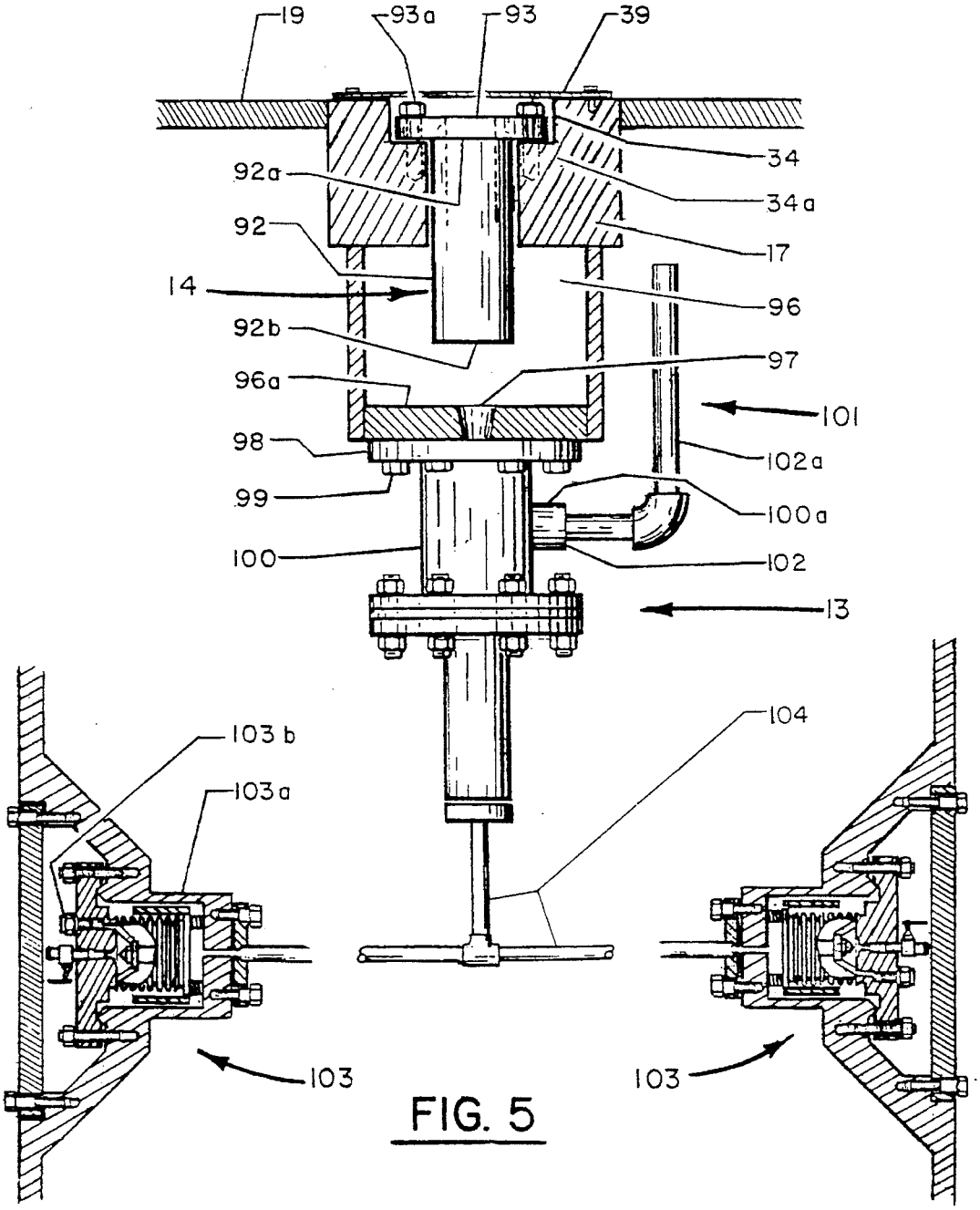
FIG. 5 is a partial longitudinal sectional view of a retracted safety relief valve connected to a safety relief shut-off valve and a side sectional view of a blow-out safety device.

As shown in FIG. 5, a first recess 34 comprises a retracted pressure safety relief valve 14 including a safety pressure relief valve shut-off 13 connected thereto to a blowout safety device 103. The safety pressure relief valve shut-off 13 and the blowout safety device 103 will be described in greater detail later.

Currently-used safety pressure relief valves protrude out from the shell of a pressurized vessel, subjecting the valve to possible damage from collision, vandalism or other hazards. The pressure safety relief valve operates through a mechanism which opens the valve when the pressure in the vessel reaches a dangerously high level, allowing part of the product to escape, and then closing again when the pressure has returned to normal, safe levels. The pressure safety relief valve 14 of the present invention is in a retracted position, an improvement over the currently-used relief valves.

The safety pressure relief valve 14 can have a variety of shapes but is preferably a straight cylinder 92 with a valve discharge 92*a* at one end and an inlet aperture 92*b* at the opposite end. The discharge end 92*a* terminates in a flange 93 resembling the brim of an upside down hat. The flange 93 extends radially outward from the rim of the discharge end 92*a* of the cylinder 92. The flange 93 is of such planar accuracy that it forms a leakproof seal with the bottom of the recess 34*a* when a standard gasket and bolts are employed as described earlier. The flange 93 is secured in such a manner that it rests on the bottom of the second recess 34, so that both the flange 93 and the bolts 93*a* securing the flange 93 are below the exterior surface of the vessel shell 19.

The recess 34 containing the safety pressure relief valve 14, is protected by a dust cover 39. The dust cover 39 prevents dirt, water and other nuisances from accumulating in the recess 34 and interfering with the operation of the safety pressure relief valve 14. The dust cover 39 should be strong enough to support the weight of a person who may step on it, but not so strong that it will not shatter or blow away if the safety pressure relief valve 14 discharges. Fasteners such as bolts or screws can be used to secure the dust cover 39 to the mounting plate 17 as shown in FIG. 5. The dust cover 39 can be constructed from plastic, sheet metal or any other corrosion resistant material.

The cylinder 92 of the safety pressure relief valve 14 is enclosed in a sealed chamber 96. The chamber 96 has a sufficient length that when the retracted safety valve 14 is in place, it does not contact the walls of the chamber 96. The bottom 96*a* of the chamber 96 has a thickness sufficient enough to accommodate bolts 99 holding an end plate 98 and standard gasket which together form a leakproof seal between the sealed chamber 96 and the safety pressure relief valve shut-off 13 (FIG. 5).

The safety pressure relief valve shut-off 13 connects to the chamber 96 surrounding the safety relief valve 14 through an aperture 97 which passes through the middle of the bottom 96*a* of the chamber 96 and the end plate 98 as seen in FIG. 5. The safety pressure relief valve shut-off 13 and blowout safety device 103 of the present invention were previously described in U.S. Pat. No. 5,113,893 incorporated by reference herein. The safety pressure relief valve shut-off 13 functions as a back-up system to isolate a faulty pressure relief valve 14 temporarily if a leaking problem occurs, without completely nullifying the safety relief valve 14.

As described in the '893 patent, the safety pressure relief valve shut-off 13 comprises a generally cylindrical housing 100 containing a valve body with a valve seat, a valve head, a flange, a discharge port, an actuator and an actuator conduit (all not shown). One new feature of the safety pressure relief valve shut-off 13 not described in the '893 patent is that of a remote selective inlet conduit 101 which replaces openings in the shell of the cylinder 100 of the safety pressure relief valve shut-off 13 which previously allowed product from the vessel 11 to flow through the open valve.

In the present invention, the remote inlet conduit 101 begins as an opening 100*a* in the cylindrical housing 100, wherein the opening 100*a* is surrounded by a boss 102. An extra heavy pipe or other conduit 102*a* is secured to the boss 102 and extends to a place near the top of the inside of the vessel 11 where vapor may exist. Should the safety relief valve 14 open, the remote inlet conduit 101 sends vapor rather than liquid to the valve 14 to be discharged, thereby preventing greater loss of product from within the vessel 11 while regulating the vapor pressure to safe conditions within the vessel 11. The safety pressure relief valve shut-off 13 is further connected to a blowout safety device 103 through a hydraulic pressure transmitting conduit 104.

The safety pressure relief valve shut-off 13 is normally in an open position but can be closed in the event of an emergency such as an uncontrollable leak in the relief valve 14. As described in greater detail in the '893 patent, the blowout safety device 103 comprises a bellows seal 103*a* to ensure against the loss of product in the event that any part of the internal safety pressure relief valve shut-off 13 or the hydraulic pressure transmitting conduit 104 fails, causing a leak into the blowout safety device 103. The blowout safety device 103 also comprises a blowout plug or frangible disk 103*b* which relieves the hydraulic pressure that holds the safety pressure relief valve shut-off 13 closed. Relief of the hydraulic pressure allows the normally open relief valve 14 to function if the product pressure in the vessel 11 increases to a dangerously high level.

Figure 6:
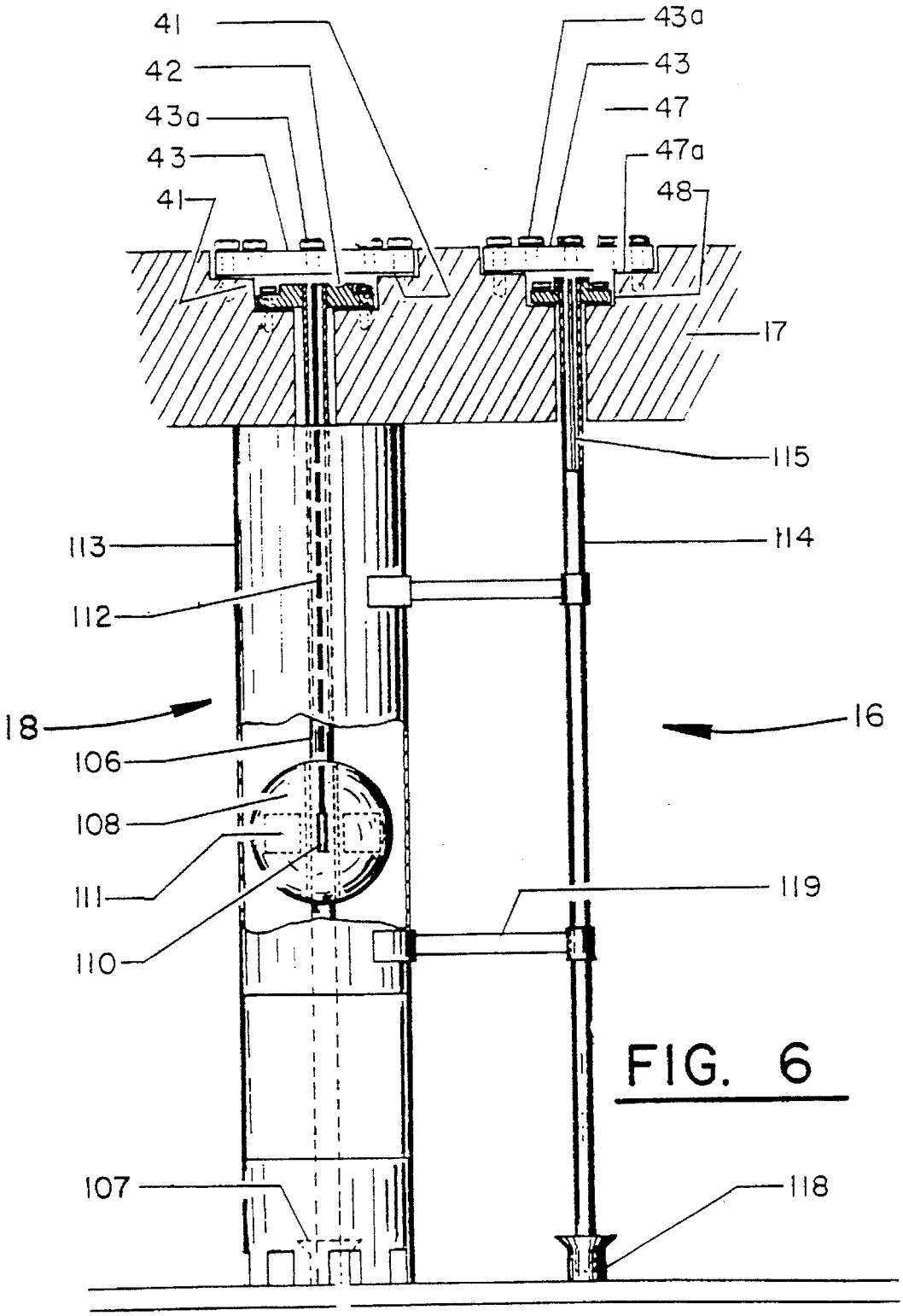
FIG. 6 is a partial sectional view of a temperature indicator and liquid level indicator that includes a float with a magnet, a stainless steel well and a gauge stick with a magnet of the opposite polarity.

In addition to the valves described above, a liquid level indicator 18 and a temperature indicator assembly 16 are also positioned in the vessel below the thickened mounting plate 17 in recesses 41, 47 covered by a protective cover 43. The protective cover 43 rests on ledges 41*a*, 47*a* within the recesses 41, 47, and are secured by bolts 43*a*. As shown in FIG. 6, below the protective cover 43, a liquid level indicator 18 and a temperature indicator assembly 16 reside within a third recess 41 and a fourth recess 47, respectively of the mounting plate 17. The liquid level indicator 18 is a product of Midland Manufacturing, Inc. of Skokie, Ill., and comprises a protective cylinder 113 containing a long stainless steel tube 106 mounted at one end by a flange 42 extending radially outward from the axis of the tube 106. The flange 42 is adapted for use with a standard gasket to form a leakproof seal when secured by bolts to the recess 41. The tube 106 extends to the bottom of the vessel 11 where it ends in funnel-shaped receptacle 107 functioning as an anchor to the tube 106. A float 108 surrounding the tube 106 contains strong permanent magnets 111 which travel up and down the length of the tube 106 depending on the level of liquid in the vessel 11. To check the level of liquid in the vessel 11, the worker removes the protective cover 43 positioned over the recess 41, and pulls up a gauge rod 112 having a magnetized bottom end 110 until the magnetized end 110 contacts the permanent magnets 111 in the float 108. The level of the liquid in the vessel 11 can be determined by the height of the gauge rod 112.

Also shown in FIG. 6 is a temperature indicator assembly 16 comprising a thermometer well 114 containing a thermometer 115 of sufficient length to extend to the bottom of the vessel 11. The thermometer well 114 is generally a cylindrical shape mounted at one end by a flange 48 extending radially out from the axis of the thermometer well 11. The flange 48 is secured to the bottom of the recess 47 by bolts as previously described for the liquid level indicator. A standard gasket is positioned between the flange 48 and the bottom of the recess 47 to form a leakproof seal. The thermometer well 114 terminates at the bottom of the vessel 11 in a funnel-shaped receptacle 118 securely attached to the bottom of the vessel 11, serving as an anchor or guide to prevent the thermometer well 114 from shifting with the product in the vessel 11. Additional lateral supports 119 can be installed along the length of the thermometer well 114 to provide additional support against the forces of the product shifting. A standard thermometer 115 in elongated form is inserted in the center of the thermometer well 114.

Figure 8:
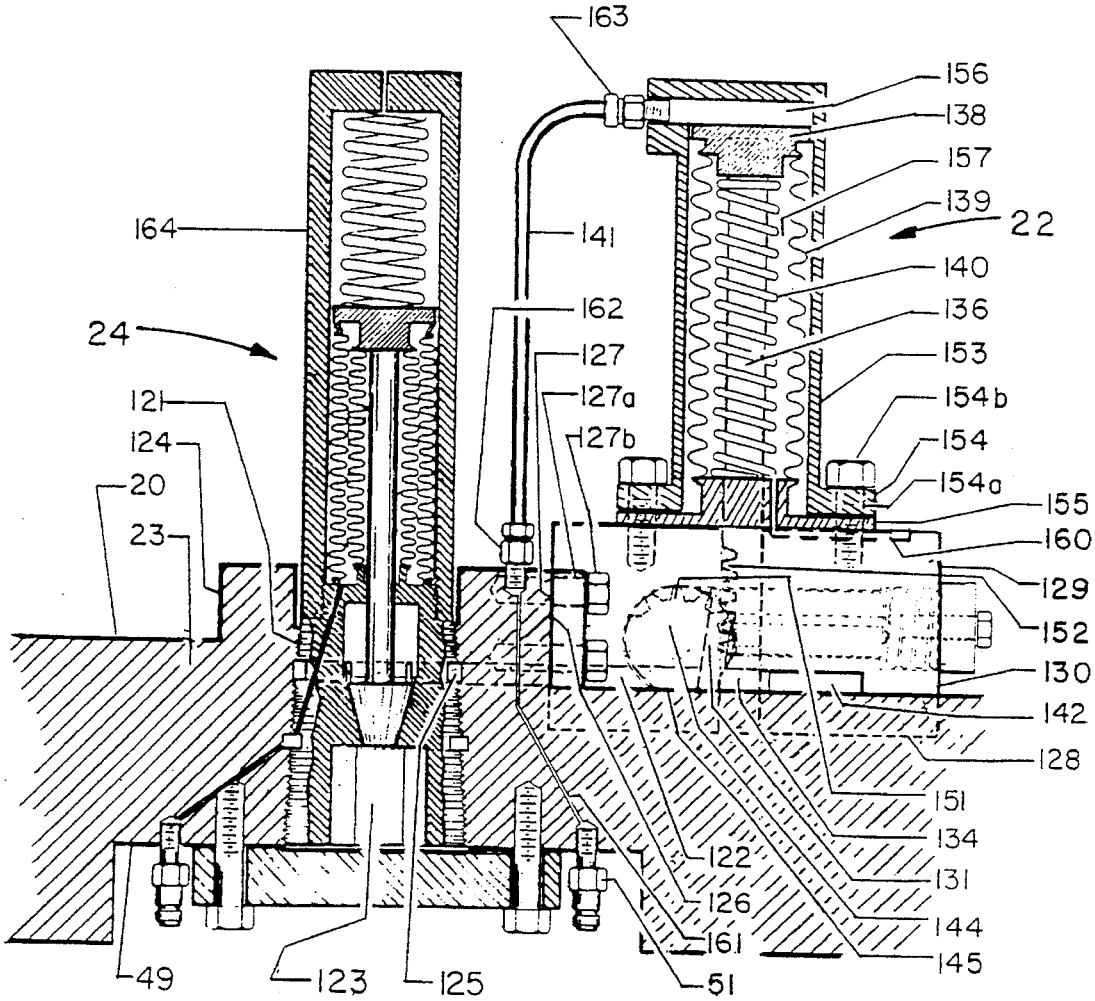
FIG. 8 is a longitudinal sectional view of a bottom port inlet-outlet retracted valve in conjunction with an internal safety shut-off valve, with the valves in a closed position; and, FIG. 9 is a longitudinal sectional view of the valves in FIG. 8 with valves in an open position.
Figure 9:
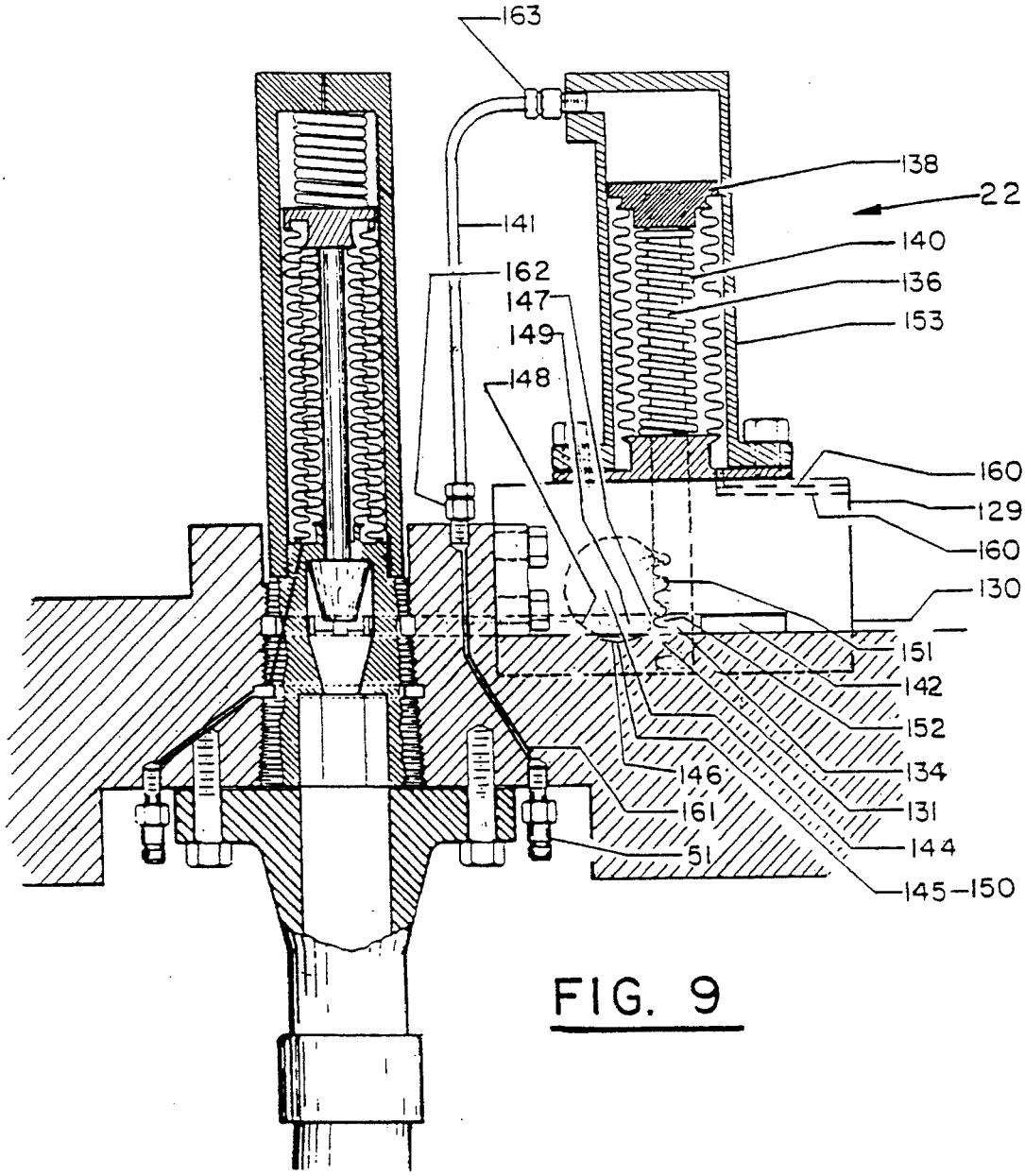

In another embodiment of the present invention, valve fixtures may also be located in the bottom of the vessel 11. These bottom fixtures are covered by a thickened mounting plate 23, similar to the mounting plate 17 described for the top of the vessel 11. As shown in FIGS. 8 and 9, a bottom inlet-outlet port retracted valve 24 connected to an bottom internal safety shut-off valve 22 are located inside the bottom of the vessel 11, residing below a recess 49 of a thickened bottom mounting plate 23. In FIG. 8, the bottom inlet-outlet port retracted valve 24 is closed, while in FIG. 9, the valve 24 is open.

The bottom inlet-outlet port retracted valve 24 is the same structure as the op inlet-outlet retracted valve 15 described previously. The bottom inlet-outlet mounting plate 23 is the same on the outside surface as the top mounting plate 17, except that the inside surface of the bottom mounting plate 23 intrudes further into the vessel, to accommodate the desired valves and fixtures. The extra thickness of the bottom mounting plate 23 is sufficient to accommodate the structure of the product duct 122 extending between the bottom internal safety shut-off valve 22 and the inlet port 123 of the bottom inlet-outlet port retracted valve 24. An additional tapered thread 124 is used to prevent product from entering the duct directly from the vessel 11 when the safety shut-off valve is closed.

As shown in FIG. 8, the product duct 122 comprises a peripheral channel 125 cut into the additional part of the tapered thread 124 in a position adjacent to the inlet port 123 of the retracted valve 24. The peripheral channel 125 has a width greater than the inlet port 123. The added width of the peripheral channel 125 provides tolerance for screwing the tapered threads 124 of the retracted valve 24 into a tight sealing position and still be within the range of providing a reasonable useful flow of product from the product duct 122 into the inlet port 123. A suitable sealing and antiseize compound for heavy duty tapered threads should be used. The product duct 122 continues in a horizontal direction to the inlet-outlet opening 126 of the bottom internal safety shut-off valve 22. The product duct 122 is preferably level with the vessel bottom to allow for adequate drainage of product from the vessel 11. The horizontal section of the product duct 122 ends with a planar surface flange 127 extending outwardly from the axis of its bore. The planar flange 127 is adapted for receiving a standard gasket. The planar flange 127 contains threaded bolt holes **127*a* adapted for receiving bolts 127*b* of sufficient size, that when tightened, establish a leakproof seal between the boss 121, the standard gasket and the planar flange 127**.

As shown in FIG. 8, the bottom internal safety shut-off valve 22 is a normally closed valve that promotes gravitational drainage of liquid from the vessel 11. Because the bottom internal safety shut-off valve 22 is normally closed, it is opened by pressurized actuating fluid, pneumatic pressure, otherwise it will close by its own propensity. The bottom internal safety shut-off valve 22 can be any suitable valve including a sliding valve, plug valve, gate valve or ball valve, but is preferably a rotating valve. Because the bottom internal safety shut-off valve 22, located completely inside the vessel 11, is designed to allow gravitational flow of product to drain from the bottom of the vessel 11, it is preferably positioned low enough within a recessed area 128 inside the thickened mounting plate 23 to allow adequate drainage.

The bottom internal safety shut-off valve 22 comprises essentially an actuator housing 153 connected to a valve body assembly 129. The actuator housing 153 has generally a cylindrical shape, wherein the bottom of the housing 153 is circumscribed by a planar flange 154 that extends radially outward from the full opening of the housing 153. The planar flange 154 includes bolt holes **154*a* through its peripheral area perpendicular to its planar surface. These bolt holes 154*a* are adapted to receive bolts 154*b* of sufficient size to facilitate attachment of the flange 154 to a movable partition flange 155 in a leakproof manner when a standard gasket is employed. The actuator housing 153 is connected by the same bolts 154*b* to a valve body assembly 129**, to be described later.

The area within the actuator housing 153 is divided into a first compartment 156, and a second compartment 157 by a piston head 138. The first compartment 156 is located above the piston head 138. The second compartment 157 is bounded by a flexible section 139 such as a bellows or diaphragm and a movable partition flange 155. Running through the center of the second compartment 157, is an actuator rod 136. One end of the actuator rod 136 is secured to the piston head 138 by any suitable means including a standard machine screw thread. The opposite end of the actuator rod 136 passes through the movable partition flange 155 into the valve body assembly 129, ending within the valve body assembly 129 as a rack of gear teeth 152. The flexible section 139 is permanently welded to the piston head 138 in a leakproof and dependable manner so as to withstand many flexing motions without fatiguing and cracking the weld. The flexible section 139 is attached, also by welding, to the movable partition flange 155 for similar reasons as above. Actuator fluid can enter and pass above the piston head 138 and around and between the outside of it and the flexible section 139 and the inside of the actuator housing 153, but not within the second compartment 157. With a standard gasket between the actuator housing flange 154 and the movable partition flange 155, connected together by bolts **154*b*, the actuator fluid is permanently sealed from mixing with product in the vessel 11**.

As shown in FIG. 9, the bottom internal safety shut-off valve 22 includes a valve body assembly 129 having a valve body 130 which includes a product conduit 134 beginning with an inlet 142. The dimension of this inlet 142 varies according to the volume of flow of the product anticipated. The product conduit inlet 142 is placed so it is not above the bottom drain line of the vessel 11 when the vessel 11 is in a level position. The product conduit 134 functions to control the flow of product entering and leaving the vessel, and isolates it from product stored in the vessel. By controlling the flow of product in this manner, the bottom internal safety shut-off valve 22 and the bottom inlet-outlet port retracted valve 24 can function properly.

At a location along the length of the product conduit 134, in a position available to the function of the actuating rod 136, is a cylindrical cavity 144. The axis of the cylindrical cavity 144 is perpendicular to and bisects the cross-section of the product conduit 134 creating a trough 145 across the bottom of the product conduit 134. This trough 145 serves as a nesting for a sealing surface 146 that functions with a rotary valve 131. Bisection of the product conduit 134 by the cylindrical cavity 144 creates two openings through which product can flow. Opening number one 147 is where the product conduit 134 enters the cavity 144, and opening number two 148 is where the product conduit 134 leaves the cylindrical cavity 144.

The generally cylindrically shaped rotary valve 131 has a passage 149 through it at a right angle to its axis and also parallel to the axis of the product conduit 134. The passage 149 is off center from the axis of the rotary valve 131, so that when the rotary valve 131 is in an open position and nested within the trough 145, the passage 149 allows product to flow freely through it. The cross-section of the rotary valve 131 is divided into unequal parts by the off-center passage 149. When the rotary valve 131 is in an open position the smaller part 150 of the valve functions as a cover over the trough 145 across the bottom of the product conduit 134, preventing erosion of the sealing surface of the trough 145, when product is passing through the product conduit 134.

One end of the rotary valve 131 comprises a pinion spur gear 151 which engages a rack of gear teeth 152 comprising part of the actuating rod 136. The actuating rod 136, as discussed earlier, is also attached to the piston head 138. Together, the actuating rod 136 and the piston head 138 comprise the rod and piston head assembly. The rod and piston head assembly is free to slide longitudinally along its own axis within the actuator housing 153. When the assembly slides, the rack of gear teeth 152 on the actuating rod 136 engage the pinion spur gear 151 causing the rotary valve 131 to revolve. When the rotary valve 131 revolves and the off-center passage 149 is in alignment with the product conduit 134, the bottom internal safety shut-off valve 22 is open. When the rotary valve 131 rotates in another position and the off-center passage 149 is not in alignment with the product conduit 134 the bottom internal safety shut-off valve 22 is closed.

The bottom internal safety shut-off valve 22 is normally in a closed position due to the force of the pressure of the product within the vessel 11 passing through a port 160 in the valve body 130. The port 160 communicates through a product tube **160*a* that extends through the valve body 130 and the previously described movable partition flange 155 into the area 157 below the piston head 138. The force of the pressure of the product motivates the piston head 138 upward, drawing the actuating rod 136 that is connected to the piston head 138 upward also. This motion causes the previously described rotary valve 131 to revolve, closing the bottom internal safety shut-off valve 22. In the event the pressure of the product in the vessel 11 is low, a spring 140 can be added to bias the bottom internal safety shut-off valve 22** to close.

To reopen the bottom internal safety shut-off valve 22, it is necessary to overcome the force of the product or the spring 140 in the vessel 11 with hydraulic or pneumatic pressurized fluid or gas, introduced through the previously described quick connector 51. The pressurized fluid is conducted through an actuating fluid conduit 161 connected to the quick connector 51 located on the outside of the bottom thickened mounting plate 23. The actuating fluid conduit 161 is connected by a first adaptor 162 to a tube 141. The tube 141 is connected to the actuator housing 153 by a second adaptor 163. At this point, hydraulic or pressurized fluid or gas enters the first compartment 156 of the actuator housing 153. When the total force of the hydraulic or pneumatic pressurized fluid or gas becomes greater against the top of the piston head 138 in the first compartment 156 than the force of the pressure of the product against the bottom of the piston head 138 in the second compartment 157, the piston head 138 will move downward causing the bottom internal safety shut-off valve 22 to open.

When both the bottom port retracted valve 24 and the bottom internal safety shut-off valve 22 are deliberately held open by the hydraulic or pressurized actuating fluid or gas, product can flow from the vessel 11. Failure to supply sufficient pressure of the actuating fluid or gas will allow pressure from the product or spring 140, 164 inside the bottom internal safety shut-off valve 22 or retracted valve 24, respectively, to close the valves 22, 24.

One of the hazards of a vessel containing a fluid is the possible rupturing force of the pressure, or liquid hammer effect, against the vessel when the vessel comes to a sudden stop, as during a collision. The buildup of pressure is the result of a combination of the velocity of the vessel at the time of the impact, the length of the column through the vessel, and the time in which the vessel stops. The installation of a protective means on the vessel can extend the time between the moment of impact of the vessel and the moment the vessel comes to a stop. Increasing this time will reduce the fluid pressure caused by the liquid hammer effect, to a safer level.

As seen in FIGS. 1 and 2, the protective means can include a multi-layered impact softener and heat resistant shroud 165. The shroud 165 can be comprised of several layers including an inner layer 166, an inflation layer 169, a casing 167 and a fire resistant cover 168. The inner layer 166, located closest to the vessel shell 19 is attached to the vessel shell 19 by chemical adherence or by welding metal reinforcement to the vessel shell 19. The shroud 165 is preferably thickest on the ends of the vessel 11 because that is the longest column through the vessel 11 and requires the greatest protection and shock absorbency in the event of a collision.

The inner layer 166, located closest to the vessel 11 can be manufactured from a plastic material, including polypropylene, polyethylene or any other suitable polymer, polyethylene or rubber.

Covering the inner layer 166 of the shroud 165 is an inflation layer 169. The inflation layer 169 can have a variable thickness depending on which part of the vessel 11 is being covered. For example, on the ends of the elongated vessel 11, the inflation layer 169 is thicker than on the sides of the vessel 11, specifically because the ends are in direct alignment with the longest column of liquid in the vessel, requiring the longest stopping time to eliminate the buildup of internal pressures as described previously. The inflation layer 169 is preferably constructed from a closed cell elastomeric polymer foam. The elastomeric foam performs similar to a compressed gas, building resistances upon impact.

The casing 167 covering and restricting the inflation layer 169, can be comprised of a fabric woven from multiple layers of cording similar to the cording of a tire, and can be made from metal cables, natural or synthetic fibers, polymers and polymer composites. Fibers from polymers and polymer composites are preferred for tensile strength, elasticity and corrosion resistance. Small steel cables can also be woven into the fabric to provide added strength to the fabric, and to resist stretch and sag over long periods of use.

The outside of the casing 167 is covered by a fire resistant covering 168. The fire resistant covering 168 can be manufactured from metal, plastics, ceramics or fabrics with added chemical fire retardants. The fire resistant covering 168 prevents heat and flame from reaching the vessel 11 and its cargo.

The multiple layers of the impact softener and heat resistant shroud 165 protect the vessel 11 from possible punctures and ruptures that may occur during a collision. In addition, the fire retardant covering also provides protection from heat and flames for both the vessel 11 and its cargo.

The valves disclosed in the present invention may be fabricated from a wide variety of materials, including metals, plastics, combinations thereof, and preferably corrosion resistant materials, such as stainless steel. The specific materials selected will depend upon the requirements of the specific chemical products in the vessel. While a specific embodiment has been illustrated and described, numerous modifications are possible without departing from the spirit of the invention, and the scope of protection is only limited by the scope of the accompanying claims.

I claim:

1. A safety vessel and valve assembly comprising:

a vessel functioning as a storage or transport container for fluids and gases, said vessel having a generally smooth exterior shell surface and at least one opening therein;

a series of valves for regulating the flow of fluids and gases into and out of said vessel, said valves being mounted to and through said vessel shell to the interior of said vessel;

a reinforcement means including a mounting plate mounted entirely within said openings of said vessel, said mounting plate substantially increasing the thickness and strength of said vessel shell for protecting said valves; and, a protective means for preventing ruptures in said vessel.

2. The assembly of claim 1 wherein said mounting plate is adapted to fit into said opening in said vessel shell in a position flush with said vessel shell maintaining the smooth exterior surface of the vessel.

3. The assembly of claim 1 wherein said protective means includes a multi-layered impact softener and a heat resistant shroud.

4. The assembly of claim 3 wherein said impact softener and heat resistant shroud includes at least an inner layer, an inflation layer, a casing and an outer fire resistant cover.

5. The assembly of claim 4 wherein said impact softener and heat resistant shroud has a thickness greater on opposed ends of said vessel than on the sides of said vessel.

6. The assembly of claim 1 wherein said series of valves includes at least one inlet-outlet port retracted valve.

7. The assembly of claim 6 wherein said inlet-outlet port retracted valve includes a valve body and actuator assembly; a product conduit for flow of product into and out of said vessel; a valve seat concentric with said product conduit; and a valve head adapted for slidably engaging with said valve seat for forming a leakprook seal or alternatively, disengaging to form an opening for product flow.

8. The assembly of claim 7 wherein said actuator assembly includes at least one bellows seal; a piston head; and a connecting rod adapted for attachment between said piston head and said valve head.

9. The assembly of claim 1 wherein said series of valves includes a bottom inlet-outlet port retracted valve connected to a bottom internal safety-shut off valve.

10. The assembly of claim 1 wherein said mounting plate is mounted within said vessel shell providing a recess for accommodating a cover plate positioned flush with said vessel shell further maintaining the smooth exterior surface of said vessel shell.

11. The assembly of claim 1 wherein said mounting plate has a thickness substantially greater than the thickness of the vessel shell.

12. The assembly of claim 11 wherein said mounting plate has a thickness sufficient for securely mounting said series of valves within the interior of said vessel.

13. The assembly of claim 12 wherein said mounting plate has sufficient thickness for accommodating enough tapered thread to establish a reliable leakproof seal when mounting said series of valves within said vessel.

14. A safety vessel and valve assembly adapted for containing potentially hazardous fluids and gases comprising:

a vessel functioning as a storage or transport container for gas or liquid having a generally smooth exterior shell surface with at least one opening therein;

a series of valves located beneath said opening in said vessel shell surface;

a reinforcement means substantially increasing the thickness and strength of said vessel shell and positionable within at least one opening in said vessel while maintaining the smooth exterior surface of said vessel shell, said reinforcement means adapted for mounting and protecting said series of valves within the vessel; and, a multi-layered protective means including an impact and heat resistant shroud having a thickness greater on opposed ends of said vessel than on the sides of said vessel for preventing punctures and ruptures of said vessel shell surface on impact.

15. The assembly of claim 14 wherein said series of valves includes at least one inlet-outlet port retracted valve.

16. The assembly of claim 15 wherein said inlet-outlet port retracted valve includes a valve body and actuator assembly; a product conduit for flow of product into and out of said vessel; a valve seat concentric with said product conduit; and a valve head adapted for slidably engaging with said valve seat for forming a leakprook seal or alternatively, disengaging from said valve seat to form an opening for product flow.

17. The assembly of claim 16 wherein said actuator assembly includes at least one bellows seal; a piston head; and a connecting rod adapted for attachment between said piston head and said valve head.

18. The assembly of claim 15 wherein said series of valves includes a bottom inlet-outlet port retracted valve connected to a bottom internal safety-shut off valve.

19. The assembly of claim 14 wherein said reinforcement means includes a mounting plate having sufficient thickness for accommodating enough tapered thread to establish a reliable leakproof seal when mounting said series of valves within said vessel.

20. The assembly of claim 14 wherein said impact softener and heat resistant shroud includes at least an inner layer, an inflation layer, a casing and an outer fire resistant cover.

* * * * *

UNITED STATES PATENT AND TRADEMARK OFFICE

CERTIFICATE OF CORRECTION

PATENT NO. : 5,465,753
DATED : November 14, 1995
INVENTOR(S) : John Schwartz

It is certified that error appears in the above-indentified patent and that said Letters Patent is hereby corrected as shown below:

Col. 2, line 27, delete "and" and insert --and-- between the words "valve" and "actuator"

Col. 9, line 51, delete "op" and insert --top--

Signed and Sealed this

Twenty-seventh Day of August, 1996

*Attest:*

Bruce Lehman

BRUCE LEHMAN

*Attesting Officer*

*Commissioner of Patents and Trademarks*